US008196234B2

(12) United States Patent
Glunk

(10) Patent No.: US 8,196,234 B2
(45) Date of Patent: Jun. 12, 2012

(54) SHOWER INSTALLATION

(75) Inventor: Guenter Glunk, Fluorn-Winzeln (DE)

(73) Assignee: Hansgrohe AG, Schiltach (DE)

( * ) Notice: Subject to any disclaimer, the term of this patent is extended or adjusted under 35 U.S.C. 154(b) by 1113 days.

(21) Appl. No.: 12/013,152

(22) Filed: Jan. 11, 2008

(65) Prior Publication Data

US 2008/0168601 A1 Jul. 17, 2008

(30) Foreign Application Priority Data

Jan. 16, 2007 (DE) ..... 10 2007 003 416

(51) Int. Cl.
*A47K 3/28* (2006.01)

(52) U.S. Cl. ..... 4/614; 4/601; 4/596; 4/541.6; 239/428; 239/452

(58) Field of Classification Search ..... 4/541.6, 4/567–570, 596, 601–603, 610, 612–616; 239/428, 449, 452
See application file for complete search history.

(56) References Cited

U.S. PATENT DOCUMENTS

| | | | | |
|---|---|---|---|---|
| 3,716,192 | A | 2/1973 | Hunter | |
| 5,205,490 | A * | 4/1993 | Steinhardt et al. | 239/449 |
| 5,321,860 | A * | 6/1994 | Steinhardt et al. | 4/601 |
| 5,678,258 | A * | 10/1997 | Healy | 4/601 |
| 5,774,907 | A * | 7/1998 | Doggwiler | 4/606 |
| 6,042,027 | A * | 3/2000 | Sandvik | 239/422 |
| 6,047,416 | A | 4/2000 | Carrier | |
| 6,134,722 | A * | 10/2000 | Lowry et al. | 4/541.1 |
| 6,148,453 | A * | 11/2000 | Sartor | 4/615 |
| 6,477,720 | B2 | 11/2002 | Tomita | |
| 6,973,682 | B2 * | 12/2005 | Zhadanov | 4/601 |
| 7,219,376 | B1 * | 5/2007 | Zhou | 4/567 |
| 7,455,247 | B2 * | 11/2008 | Kajuch | 239/451 |
| 7,748,649 | B2 * | 7/2010 | Fujii et al. | 239/548 |
| 7,908,684 | B2 * | 3/2011 | Ludlow | 4/584 |
| 2006/0218719 | A1 * | 10/2006 | Deboer et al. | 4/601 |

FOREIGN PATENT DOCUMENTS

| | | | |
|---|---|---|---|
| DE | 3600322 | A1 | 7/1987 |
| DE | 29813597 | U1 | 12/1998 |
| DE | 20211120 | | 11/2002 |
| DE | 20211120 | U1 | 11/2002 |
| DE | 10253849 | A1 | 6/2004 |
| DE | 202006010115 | | 11/2006 |
| EP | 1695766 | | 8/2006 |
| JP | 03110228 | A | 5/1991 |

OTHER PUBLICATIONS

Search Report in EP 08000599 , Mar. 25, 2009.

* cited by examiner

*Primary Examiner* — Winnie Yip
(74) *Attorney, Agent, or Firm* — Duane Morris LLP

(57) ABSTRACT

A shower installation with discharge nozzles for horizontal installation near the ceiling is constructed to be swiveled between a resting position and an active position, wherein at least a section of the discharge nozzles protrudes in the active position. To swivel the mounting of the shower device, an operating device is provided that swivels the shower device mounting via the force of water flowing to the shower devices.

17 Claims, 2 Drawing Sheets

SHOWER INSTALLATION

FIELD OF APPLICATION AND PRIOR ART

The invention relates to a shower installation for wall or ceiling installation with at least one movable shower device.

It is a matter of common knowledge to attach hand-held shower devices to grip bars, possibly with an adjustable slider. The hand-held shower device can hereby be moved or rotated or swiveled on the mounting in such a way that it is possible to vary the jet spray direction of the hand-held shower device.

A shower system with an elongated housing that features a movable shower arm is known from DE 298 13 597 U1. The shower arm is hinged around a horizontal axis in the upper area of the housing and it can be swiveled from a vertical resting swivel position to a horizontal active position.

PROBLEMS AND SOLUTIONS

The invention is based on the task of creating a shower installation, as stated at the beginning, which prevents the problems known in the prior art and which, in particular, features a shower device on a shower installation that can be moved in a novel and advantageous manner.

This problem is solved via a shower installation with the features disclosed and claimed herein. Advantageous and preferred embodiments of the invention are explained in greater detail in the following. The wording of the claims becomes the content of the description and is incorporated through explicit reference.

The shower device can be moved between a resting position and an active position. In the resting position, it is largely enveloped in the shower installation or behind an exterior or surface of the shower installation, wherein it can also form a part of the exterior surface, and can thus lie approximately flush or even with this surface. In the active position, it is moved or rotated out of the shower installation and it can thereby extend beyond the exterior or surface of the shower installation. In accordance with the invention, the shower installation features an operating device that can be used to move at least the shower device from the resting position to the active position, wherein the operating device can be driven or activated by water that flows to the shower device. It is advantageous to ensure that a large part of the force or the entire force required for moving the shower device is substantially supplied by the water flowing to the shower device. Such self-activating shower devices do not require operators to intervene. It is sufficient if a fitting that is usually designed for the shower installation, and in particular an adjustment fitting between other shower device units in the shower installation and the movable shower device, is operated accordingly so that the movable shower device not only dispenses water, but is also moved to the active position. Details of the manner of movement, as well as the precise manner in which the resting position and the active position can be designed, will be described in greater detail in the following.

It can be advantageous to design the operating device in such a way that, via the water flowing to it, it moves the movable shower device directly from the resting position to the active position without any intermediate position. End stops can hereby be provided to specify maximum movement to the resting position and the active position. In this way it can be ensured that the movable shower device is always located in either the resting position or in the active position except during the brief movement phase itself. This makes it possible to reliably avoid intermediate positions with poorly defined jet spray direction and water output. In specific embodiments of the invention, it can be provided that, when water begins to flow to the movable shower device, the shower device is first moved entirely or nearly to the active position before water actually flows out of it, which is an especially effective method for guaranteeing well-defined jet spray direction.

In further embodiments of the invention, the operating device can be designed in such a way that, when the water flow stops, the shower device automatically moves from the active position to the resting position, and is thereby deactivated, as it were. For this reverse movement, a reset force or return spring can be provided to move the shower device via the spring force. For the movement from the resting position to the active position, this force is overridden by the flowing water and/or the operating device. It can be advantageous to place the return spring outside areas through which water flows, i.e. in a dry area. It is advantageous to design it as a plastic spring, and particularly advantageous to design it as a type of flat spring or similar. Alternatively, resetting can also be performed via gravity with a deflected shower device.

According to a preferred embodiment of the invention, the shower device moves back and forth between the resting position and the active position using a swivel movement. The swivel axis of this swivel movement can run past the discharge jets of the shower device, wherein it can be particularly effective to arrange the discharge jets lower in the shower installation when in the resting position than in the active position. It is hereby possible to route the water flowing to the shower device so that it essentially runs along the swivel axis. For this, a pipe or line, for example, can form the swivel axis to which the shower device is essentially attached. In such cases, a sealed inlet can be created using a seal between a supply line in the shower installation and the pipe or line leading to the shower device and used for swiveling.

It can be advantageous for the swivel movement between the resting position and the active position to feature a swivel angle of around 5.degree. to 45.degree., thereby allowing for a relatively small swivel movement. It can also have a wider swivel angle, however.

In another embodiment of the invention, the movable shower device can be moved out of the shower installation in an essentially linear fashion via the building water pressure of the inflowing water. Here, water can be supplied using a flexible hose, for example. In an alternative embodiment of the invention, the supply line can be designed as a telescoping pipe. This pipe can be extended via the build-up of pressure from inflowing water and this extension movement then causes the shower device to move, as will generally be explained in greater detail in the following.

According to an embodiment of the invention, the shower device, or its discharge surface or discharge jets in the resting position, form part of a surface or exterior of the shower installation, wherein the surface or exterior of the shower installation is preferably basically flat or even. The shower device and/or discharge jets are hereby at least partially accessible and/or visible, i.e. slightly in-set or swiveled in. This features the advantage, for example, that the outlet nozzles, which are now very frequently made of elastic material such as silicon, can also be accessed for cleaning purposes even when in the deactivated state. Alternatively, they can be visible but also enveloped in the surface or exterior of the shower installation, i.e. retracted into it, as it were.

In accordance with yet another embodiment of the invention, the shower device and/or its discharge jets are again enveloped in the shower installation when in the resting position, but in this case they are not visible from the exterior and/or cannot be readily accessed. Here, it can particularly be provided that the surface or exterior of the shower installation is largely closed off in the shower device area when the shower device is in the resting position. This features the advantage that the movable shower device is not noticeable or visible at first sight and, upon activation, it appears or moves out of the shower installation unexpectedly, so to speak. This results in a design that is closed off for hygienic reasons and purist in style for aesthetic reasons.

The shower device can be arranged on a shower device mounting, either alone or together with additional movable shower devices. This shower device mounting is also attached to the shower installation in a movable fashion, and it ensures that the shower device can be moved between the resting and active positions. If multiple shower devices are arranged on such a shower device mounting, it is advantageous that they be arranged next to one another in a straight line, and particularly in a line running parallel to the swivel axis previously mentioned in the case of a swivel movement. The overall shower installation can be equipped with a single shower device mounting or potentially with a multitude of such mountings. Furthermore, it is possible for the shower device mounting to be considerably longer in the swivel axis direction than it is in the transverse direction, particularly when it includes multiple shower devices. In this way, the swivel movement is identical for all of the movable shower devices.

On the one hand, the operating device can be designed in such a way that water flowing to the shower device exerts pressure on the wall of a chamber located inside an inlet in the operating device, thereby moving this chamber wall. The chamber wall simultaneously moves the shower device, in particular via hinge components. Furthermore, it is advantageous to design the chamber in such a way that the water flowing to the shower device does not flow around or behind the movable chamber wall, i.e. the chamber also remains water-proof, as it were, in the area of the movable chamber wall. Here, the chamber wall can be a separate movable part that is sealed off from any other chambers. The chamber wall can be movable in the form of a projection or it can move a projection, thereby moving or swiveling the shower device. For example, in the case of a shower installation installed in the ceiling, the chamber wall can press from above against a shower device mounting in order to swivel the mounting downwards or to swivel one of the shower devices arranged on the shower device mounting out from the shower installation. When the water supply stops, a reset force or return spring as previously mentioned can swivel the shower device mounting back to the resting position, thereby also moving back the chamber wall.

On the other hand, the operating device can feature a synchronization element in a water inlet for the shower device. The water flowing to the shower device flows past or around this element, thereby moving it from a static position to an operating position. The synchronization element is operationally associated with the shower device, or moves it using hinge components, in such a way that the shower device moves exactly as it does, particularly at least in the movement from the resting position to the active position. The synchronization element is thus located immediately in the water flow and can, for example, be designed as a ball or in an oblong rounded shape. In particular, it can also essentially seal off an inlet in the resting position and is moved when water flows to the shower device.

In addition to the movable shower device, the shower installation can also feature further shower device devices. These can be designed in a fixed or unmovable fashion and can be operated like the movable shower device via adjustment or mix fittings.

In embodiments of the invention, the shower device is relatively small, with a diameter of 3 cm to 10 cm, for example. It can feature a small number of discharge jets, for example two to ten or fifteen discharge jets. It is advantageous for a shower device mounting as mentioned previously to feature multiple movable shower devices in a row, for example four shower devices.

These and additional characteristics arise from the claims, as well as from the description and the technical drawings, whereby specific characteristics can be implemented either individually or multiply in the form of sub-combinations in embodiments of the invention or in other domains, and can represent advantageous and patentable embodiments, for which protection is hereby requested. The subdivision of the application in individual sections and intermediate headings does not restrict the general validity of the statements made therein.

BRIEF DESCRIPTION OF THE DRAWINGS

An example of an embodiment of the invention is schematically portrayed in the drawings and will be explained in greater detail in the following. The drawings depict.

DETAILED DESCRIPTION OF AN EXEMPLARY EMBODIMENT

Figure 1:
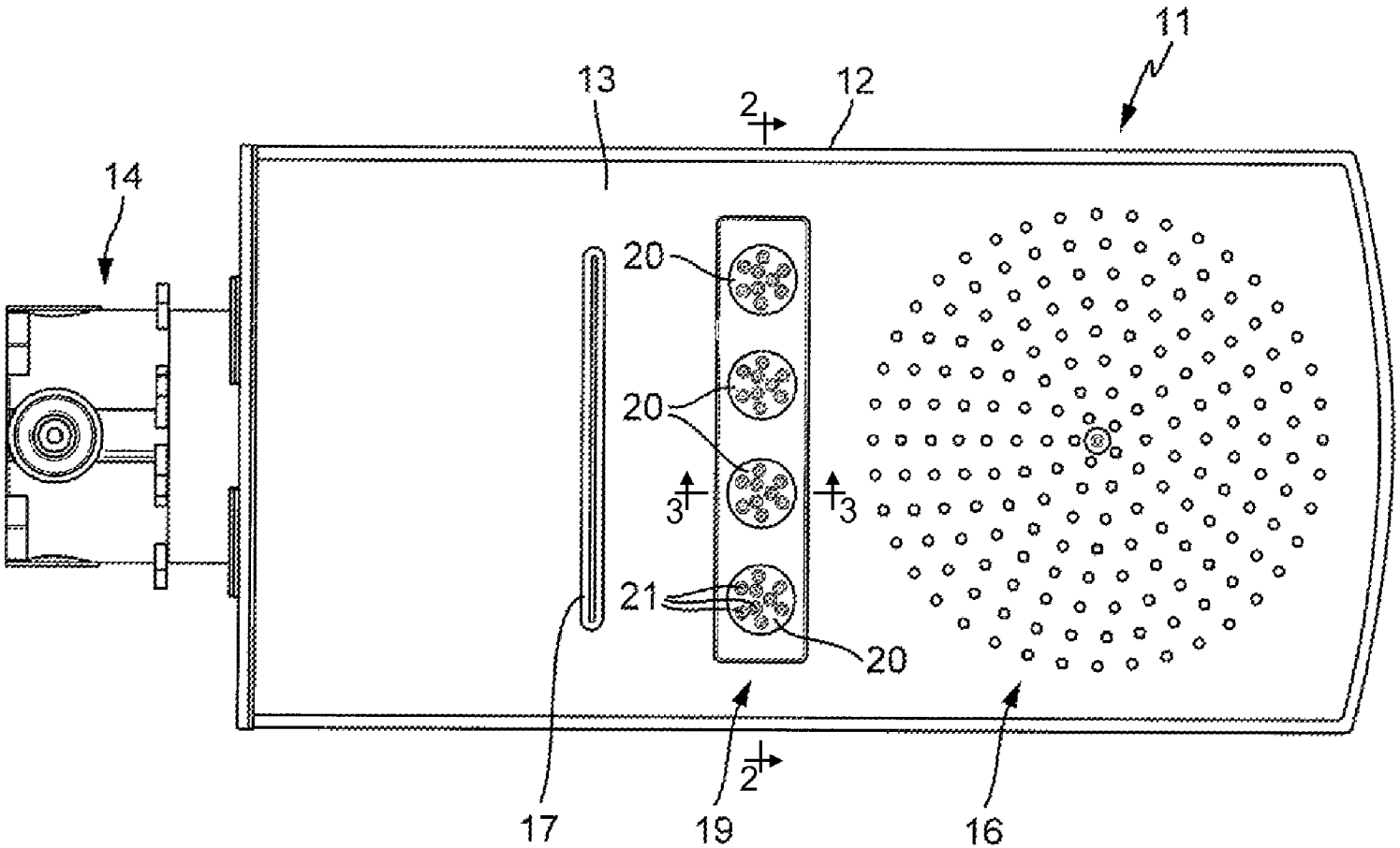
FIG. 1 a view from below of a shower installation in accordance with the invention, as the device can be installed in a ceiling or near a ceiling, FIG. 2 an enlarged sectional drawing of the shower installation from FIG. 1 with a lateral cross-section of movable shower devices, FIG. 3 an enlarged detail drawing of a lengthwise cross-section of the depiction from FIG. 1 with a shower device in the resting position and FIG. 4 the shower device from FIG. 3 after swiveling to the active position.

FIG. 1 shows a view from below of a shower installation 11 in accordance with the invention in a flat and large-surface design with a housing 12 and housing bottom 13. The left of the shower installation 11 is equipped with an attachment element 14 for installation high on the wall above a shower or just underneath the ceiling, so that the housing bottom 13 lies largely horizontal.

The housing bottom 13 of the shower installation 11 is equipped with several shower devices, namely a round shower device 16 with multiple discharge jets, a dousing shower 17 in the form of a very long slit and a movable shower device 19 between them. The movable shower device 19 features four movable shower devices 20, each with nine discharge jets 21, which are attached together on a movable or swiveling shower device mounting 23. All shower device devices 16, 17 and 19 essentially discharge water downwards or at least at a downwards slant.

Figure 2:
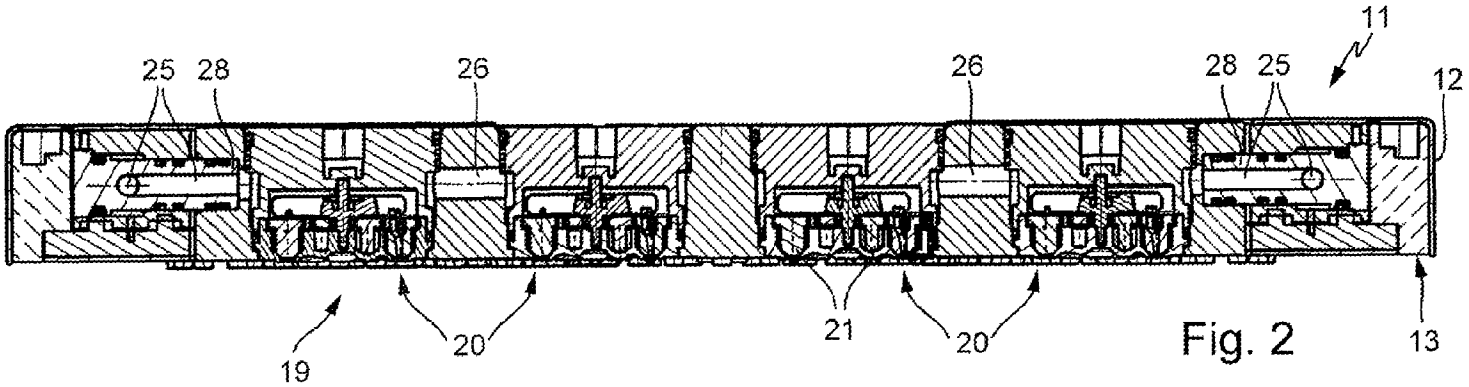

FIG. 2 shows a sectional drawing of the lengthwise axis of the shower device mounting 23 and of the shower installation 11 at this location. It can be observed that the movable shower devices 20 and their discharge jets 21 do not project or do not substantially project beyond the housing bottom 13, so that they are not actually hidden, but are at least enveloped. It can also be observed that inlets 25 are provided for water supply to the left and right of the shower device mounting 23 at the movable shower devices 20 respectively located on the far left and far right. Inwards are located the additional inlets 26 for the adjacent shower devices 20. The inlets 25 are arranged in pipe sections 28 that are positioned in a sealed manner in the shower installation 11 and housing 12, as well as in the shower device mounting 23. The pipe sections 28 are used as swivel axes for the shower device mounting 23 and thereby have a double function as inlets 25 and mechanical swivel axes.

Figure 4:
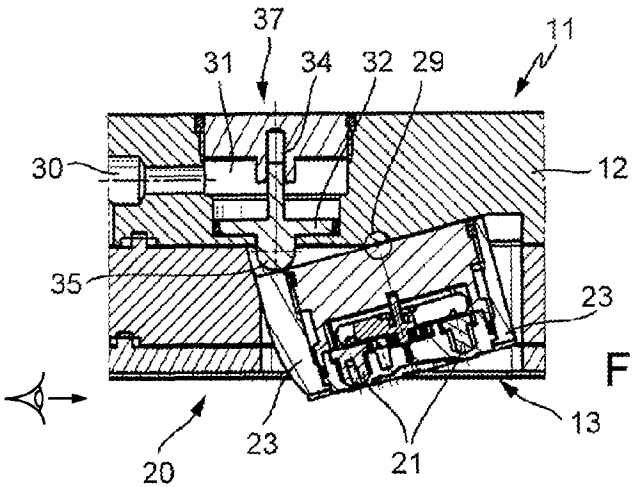
Figure 3:
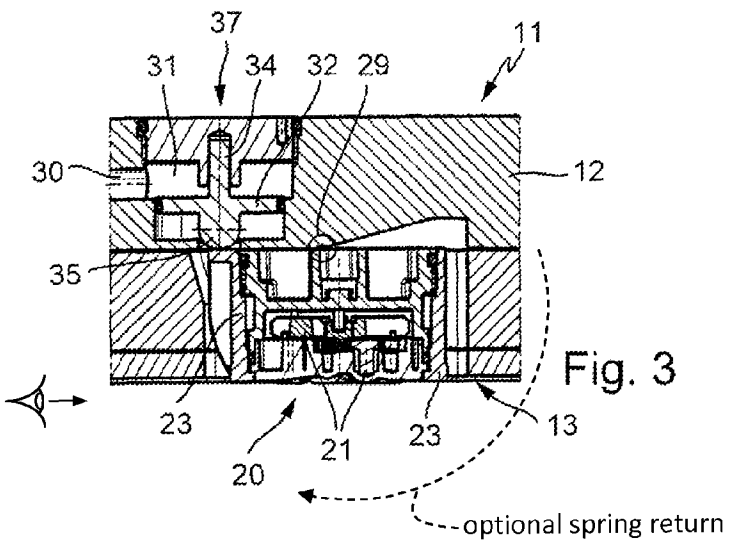

The swivel movement is illustrated in FIG. 3 and FIG. 4. These depict an enlarged detail drawing with a line of vision along the swivel direction and along the axes of the pipe sections 28. The swivel axis 29 is symbolically depicted running into the drawing plane in FIG. 3 and FIG. 4.

A chamber 31 is provided inside a supply line 30 for water that flows to the movable shower devices 20. This chamber features a piston 32 on its bottom or as its floor, and this piston can be moved upwards or downwards, sealed within the housing 12. For precise control of this movement, the piston 32 features, towards the top, a guide plunger 34 fed into the housing and, towards the bottom, a broad and somewhat shorter projection 35. This projection 35 lies against one upper left edge of the shower device mounting 23.

If water meant to be released through the movable shower devices 20 and their discharge jets 21 now flows through the supply line 30, it runs into the chamber 31. The water pressure presses the piston 32 downwards, whereby it should be observed that its exterior is always connected in a sealed manner with the housing 12 and no water can pass through here. The downward movement of the piston 32 and the associated downward movement of the projection 35 causes the shower device mounting 23 to swivel, as is portrayed for purposes of comparison in FIG. 4. Here, the piston 32 in the chamber 31 is moved to its maximum downward position and the shower device mounting 23 also presses against the housing 12, thus limiting its swivel movement and defining the active position. The resting position is depicted in FIG. 3. Via the swivel movement around the swivel axis 29, at least the discharge jets 21 of the movable shower devices 20 portrayed on the left in FIG. 4, as well as a part of the actual shower devices 20, extend beyond the housing bottom 13. They thereby become visible and it possible to observe that they have begun functioning. Furthermore, it is also possible to hereby change the jet spray direction from a vertical, downwards direction to a slanted direction. The swivel angle here is around 15.degree., but this can also be greater or smaller.

In embodiments of the invention it is possible, particularly given the two inlets 25 indicated on the left and right in FIG. 2, to provide two separate inlets, with one of these inlets 25 running through the operating device 37 according to FIGS. 3 and 4, thereby causing the movable shower devices to make a swivel movement when water is flowing, and with the other inlet 25 running directly to the shower devices 20 without passing through the operating device 37. The two inlets could be supplied with water via differing adjustments on a fitting positioned on the way to the attachment element 14.

From FIG. 3 and FIG. 4 it is clearly apparent that repositioning of the swivel axis 29 can result in an even larger swivel movement for the movable shower devices 20 and the discharge jets 21 or can alternatively result in elimination of the swivel movement.

There is no depiction here of a return spring to generate force for resetting the shower devices 20 and/or the shower device mounting 23 from the active position according to FIG. 4 to the resting position according to FIG. 3. However, specialists would find this simple and self-explanatory to design.

Furthermore, it is possible to design the swivel axis 29 somewhat to the left of the balance point or center point of the shower device mounting 23, so that when water supply ceases, gravity causes a reverse swiveling movement of the shower device mounting 23 from the active position to the resting position while simultaneously pressing up the piston 32 in the chamber 31.

Due to the easily adjustable modification of FIGS. 3 and 4, it is possible to equip the piston in the chamber with openings, so that it is indeed moved by through-flowing water, but also simultaneously lies in the flow path to the movable shower devices. However, the piston must then be connected on the bottom with an inlet or supply line to the shower devices, which makes sealing somewhat more complicated, but which is nonetheless entirely feasible to implement.

Through conversion and redirection it is also conceivable that the movable piston 32 according to FIG. 3 runs through a longer actuating stroke, resulting in a considerably wider swivel angle for the shower device mounting 23 and the movable shower devices 20. It is even conceivable that these shower devices be swiveled by 180.degree., thereby revealing a flat exterior side when in the resting position, so that the housing bottom of the shower installation appears to be closed. In the active position, the discharge jets then become visible and water emerges from the shower installation.

What is claimed is:

1. A shower installation for wall or ceiling installation, comprising:

at least one movable shower device at an exterior surface of said shower installation, wherein said shower device is movable between a resting position, in which position said shower device essentially occupies and is beneath part of the exterior surface of said shower installation, and an active position, in which position said shower device extends beyond said exterior surface, further comprising an operating device in said shower installation, the operating device moving said shower device from said resting position to said active position, wherein said operating device is driven by water flowing in the shower installation toward the shower device, to be dispensed by said shower device.

2. The shower installation according to claim 1, wherein the shower device abuts end stops in the resting position and in the active position, respectively, and wherein said operating device moves said shower device directly from said resting position to said active position when driven by said water.

3. The shower installation according to claim 1, wherein said operating device is configured such that, when said water stops flowing in the shower installation toward said shower device, said shower device automatically returns from said active position to said resting position.

4. The shower installation according to claim 1, further comprising a spring return operable for automatically moving the shower device from said active position to said resting position when not driven by said water.

5. The shower installation according to claim 1, wherein the water to be dispensed by the shower device is emitted at discharge jets on a discharge surface of the shower device, wherein movement of said shower device by the operating device, between said resting position and said active position, is a swivel movement around a swivel axis, and wherein the swivel movement determines a direction of emission of the discharge jets in the active position.

6. The shower installation according to claim 5, further comprising a pipe defining the swivel axis, and wherein the pipe is configured to carry said water flowing toward the shower device to be dispensed.

7. The shower installation according to claim 5, wherein the discharge surface of said shower device is substantially flush with an exterior of said shower installation when in said resting position.

8. The shower installation according to claim 1, wherein said shower device is disposed at and beneath the exterior surface of said shower installation in the resting position and a discharge surface of the shower device is visible in said resting position.

9. The shower installation according to claim 1, further comprising a shower device mounting attached to the shower installation and wherein said shower device is arranged on the shower device mounting.

10. The shower installation according to claim 9, wherein plural said shower devices are provided on said shower device mounting, and are arranged next to one another in a line.

11. The shower installation according to claim 10, wherein movement of said shower device by the operating device, between said resting position and said active position, is a swivel movement around a swivel axis, wherein said shower device mounting is longer in a direction along said swivel axis than in a transverse direction, and wherein several of said shower devices are arranged next to one another and parallel to said swivel axis.

12. The shower installation according to claim 1, further comprising a synchronization element in the operating device, at an inlet of a flowpath for said water flowing toward said shower device, wherein the synchronization element is moved upon application of pressure from the water, and wherein said synchronization element is operationally associated with said shower device in such a way that movement of the synchronization element causes movement of said shower device.

13. The shower installation according to claim 1, further comprising at least one additionally installed shower device provided in a fixed and non-movable way.

14. The shower installation according to claim 13, wherein the water flowing to said shower device is divided between said movable shower device and said additionally installed shower device via an adjustment fitting.

15. The shower installation according to claim 1, wherein said shower device is relatively small and has relatively few discharge jets, compared to a size and a number of discharge jets of said shower installation as a whole.

16. A shower installation for wall or ceiling installation, comprising:

at least one movable shower device at an exterior surface of said shower installation, wherein said shower device is movable between a resting position where said shower device essentially is at and beneath the exterior surface of said shower installation, and an active position, in which position said shower device extends beyond said exterior surface, an operating device in said shower installation, configured for moving said shower device from said resting position to said active position, wherein the operating device comprises a movable wall of a chamber disposed at an inlet along a path of water flowing in the shower installation toward an outlet from which the water is dispensed by said shower device, wherein the water flowing to said shower device exerts pressure on the movable wall of the chamber within the inlet and thereby moves said movable wall, wherein said movement of said movable wall due to said pressure moves said shower device into the active position for dispensing the water by the shower device, and wherein the water does not flow around said movable wall.

17. The shower installation according to claim 16, wherein said shower device is mounted on a swivel axis, and said movable wall is coupled to a projection that presses against the shower device to swivel the shower device into the active position.

* * * * *